US011878254B2

(12) United States Patent
Takebayashi

(10) Patent No.: US 11,878,254 B2
(45) Date of Patent: Jan. 23, 2024

(54) WISDOM RING PUZZLE

(71) Applicant: i Subaru Co., Ltd., Joetsu (JP)

(72) Inventor: Koji Takebayashi, Joetsu (JP)

(73) Assignee: I SUBARU CO., LTD., Joetsu (JP)

( * ) Notice: Subject to any disclaimer, the term of this patent is extended or adjusted under 35 U.S.C. 154(b) by 0 days.

(21) Appl. No.: 17/979,982

(22) Filed: Nov. 3, 2022

(65) Prior Publication Data

US 2023/0141918 A1 May 11, 2023

(30) Foreign Application Priority Data

Nov. 8, 2021 (JP) ..... 2021-182095

(51) Int. Cl.
*A63F 9/08* (2006.01)

(52) U.S. Cl.
CPC ..... *A63F 9/0876* (2013.01)

(58) Field of Classification Search
CPC ..... A63F 9/0876
USPC ..... D21/482; 273/159
See application file for complete search history.

(56) References Cited

U.S. PATENT DOCUMENTS 1,133,061 A * 3/1915 Quarles ..... A63F 9/0876 D21/482
3,698,719 A * 10/1972 Winslow ..... A63F 9/0876 273/158
4,221,386 A * 9/1980 Wisniewski ..... A63F 9/0876 273/159
4,907,805 A * 3/1990 Watkins ..... A63F 9/0876 273/158
4,957,292 A 9/1990 Ushiyama
2005/0093234 A1* 5/2005 Cooke ..... A63F 9/0876 273/153 R
2020/0246685 A1* 8/2020 Takebayashi ..... A63F 9/0876
2020/0330854 A1 10/2020 Takebayashi
2023/0135937 A1* 5/2023 Takebayashi ..... A63F 9/0876 273/159

FOREIGN PATENT DOCUMENTS

DE 9318115 U1 * 3/1994
JP H2-283392 A 11/1990
JP 6112956 B2 4/2017
JP 6546364 B1 7/2019

* cited by examiner

*Primary Examiner* — Steven B Wong
(74) *Attorney, Agent, or Firm* — HAUPTMAN HAM, LLP

(57) ABSTRACT

A wisdom ring puzzle including: a stage; a first ring unit positioned in a first direction with respect to the stage; a second ring unit positioned in the first direction with respect to the first ring unit; a third ring unit positioned in the first direction with respect to the second ring unit; a first pole connected to the first ring unit and the stage, and passing through an inner side of the second ring unit and an inner side of the third ring unit; a second pole connected to the second ring unit and connected to the stage through an inner side of the first ring unit; and a third pole connected to the third ring unit and connected to the stage crossing over an outer side of the first ring unit and an outer side of the second ring unit.

17 Claims, 9 Drawing Sheets

WISDOM RING PUZZLE

CROSS REFERENCE TO RELATED APPLICATIONS

This application claims the benefit of priority to Japanese Patent Application No. 2021-182095, filed on Nov. 8, 2021, the entire contents of which are incorporated herein by reference.

FIELD

An embodiment of the present invention relates to a wisdom ring puzzle. More specifically, an embodiment of the present invention relates to a wisdom ring puzzle having a three-dimensional structure including a pole and a ring member which can be enjoyed using a looped lace.

BACKGROUND

As represented by the Chinese ring, there is known a wisdom ring puzzle composed of a rod-shaped pole, a ring member arranged at a tip of the pole, and a looped lace. In recent years, a wisdom ring puzzle composed of a combination of a pole and a ring member using the Chinese ring as a prototype has been proposed (Patent No. 6112956 and Japanese laid-open patent publication No. H2-283392). Further, Patent No. 6546364 is proposed as a wisdom ring puzzle having a different structure from that of the Chinese ring. The wisdom ring puzzle according to Patent No. 6546364 is a puzzle having a three-dimensional structure and uses a looped lace.

The wisdom ring puzzle described in U.S. Pat. No. 6,112,956 and Japanese laid-open patent publication No. H2-283392 is complicated to solve, but there are many repetitions of simple mechanical operations, so that there are few stimuli to the logical thinking and imagination of a player. Therefore, there is a problem in that the player cannot have a contiguous interest and motivation to create a solution for these wisdom ring puzzles.

SUMMARY

A wisdom ring puzzle according to an embodiment includes: a stage; a first ring unit positioned in a first direction with respect to the stage; a second ring unit positioned in the first direction with respect to the first ring unit; a third ring unit positioned in the first direction with respect to the second ring unit; a first pole connected to the first ring unit and the stage, and passing through the inner side of the second ring unit and the inner side of the third ring unit; a second pole connected to the second ring unit and connected to the stage through the inner side of the first ring unit; and a third pole connected to the third ring unit and connected to the stage crossing over the outer side of the first ring unit and the outer side of the second ring unit.

The wisdom ring puzzle may include a fourth ring unit between the second ring unit and the third ring unit. The fourth ring unit may be connected to the first pole. The third pole may be connected to the stage through the inner side of the fourth ring unit.

The wisdom ring puzzle may include a fifth ring unit between the stage and the first ring unit; and a fifth pole connected to the fifth ring unit and connected to the stage. The second pole may be connected to the stage through the inner side of the first ring unit and the inner side of the fifth ring unit.

The first pole may be connected to the stage crossing over the outer side of the fifth ring unit.

The third pole may be connected to the stage crossing over the outer side of the fifth ring unit.

DESCRIPTION OF EMBODIMENTS

Figure 1A:
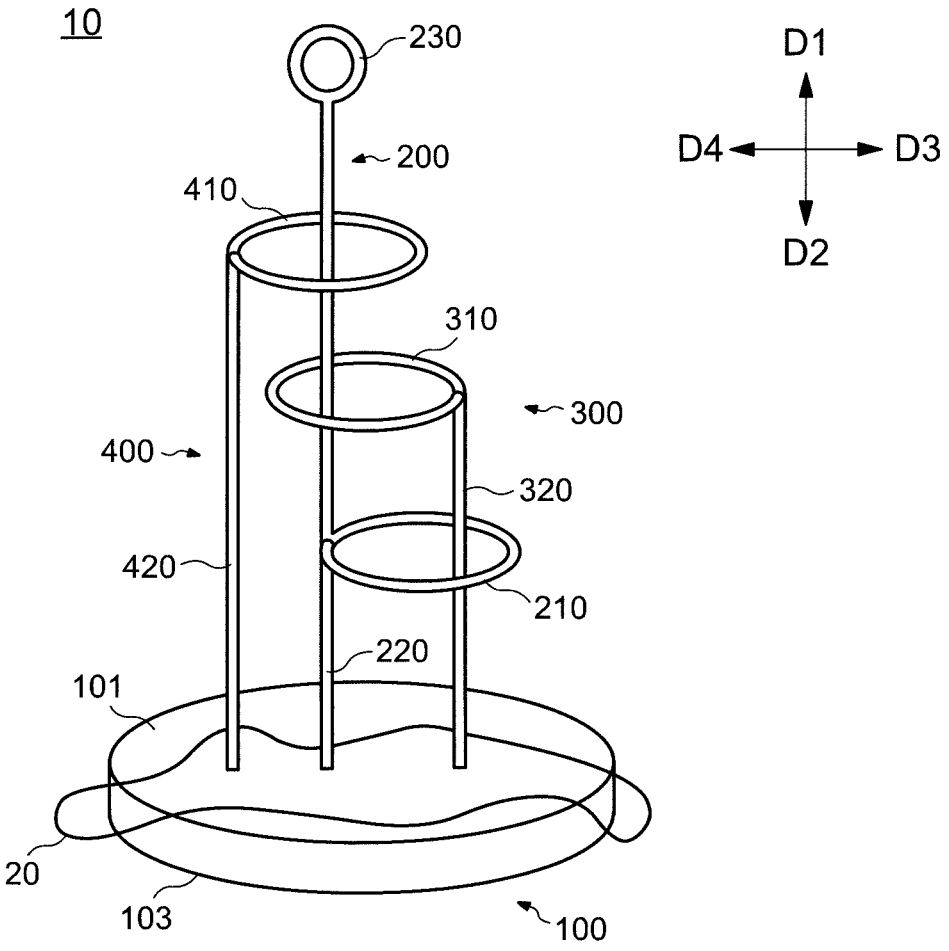
FIG. 1A is a diagram showing a structure of a wisdom ring puzzle according to an embodiment of the present invention.

Hereinafter, a wisdom ring puzzle according to the present embodiment will be described in detail with reference to the drawings. In the following description, elements having substantially the same functions and configurations are denoted by the same symbols and will be described redundantly only when necessary. The following embodiments exemplifies a device and method for embodying the technical idea of this embodiment. The technical idea of the embodiment is not to specify the material, shape, structure, arrangement, or the like of the constituent parts as follows. Various modifications may be made to the technical idea of the embodiment in addition to the scope of the claims.

In each embodiment of the present invention, direction from a stage 100 toward each structure body (e.g., a first structure body 200) is referred to as upper direction or first direction. On the contrary, direction from each structure toward the stage 100 is referred to as lower direction or second direction. As described above, for convenience of explanation, although the phrase "upper" or "lower" is used for explanation, for example, the stage 100 and the first structure body 200 may be arranged so that the vertical relationship is opposite to the drawing. In the following description, for example, the expression "the first structure body 200 above the stage 100" merely describes the vertical relationship between the stage 100 and the first structure body 200 as described above, and other members may be arranged between the stage 100 and the first structure body 200. The upper direction or lower direction means the vertical relationship in a vertical direction in the plurality of members, and the expression "the first structure body 200 above the stage 100" indicates the positional relationship in which the stage 100 and the first structure body 200 do not overlap in a plan view. On the other hand, the expression "the first structure body 200 vertically above the stage 100"

indicates the positional relationship in which the stage 100 and the first structure body 200 overlap in a plan view.

In the present specification, expressions "a includes A, B, or C," "a includes any of A, B, and C," and "a includes one selected from a group consisting of A, B, and C," do not exclude the case where a includes a plurality of combinations of A to C unless otherwise specified. Furthermore, these expressions do not exclude the case where a includes other elements.

An object of an embodiment of the present invention is to provide a wisdom ring puzzle capable of sustaining the interest and motivation of a player to create a solution.

1. First Embodiment

Figure 1B:
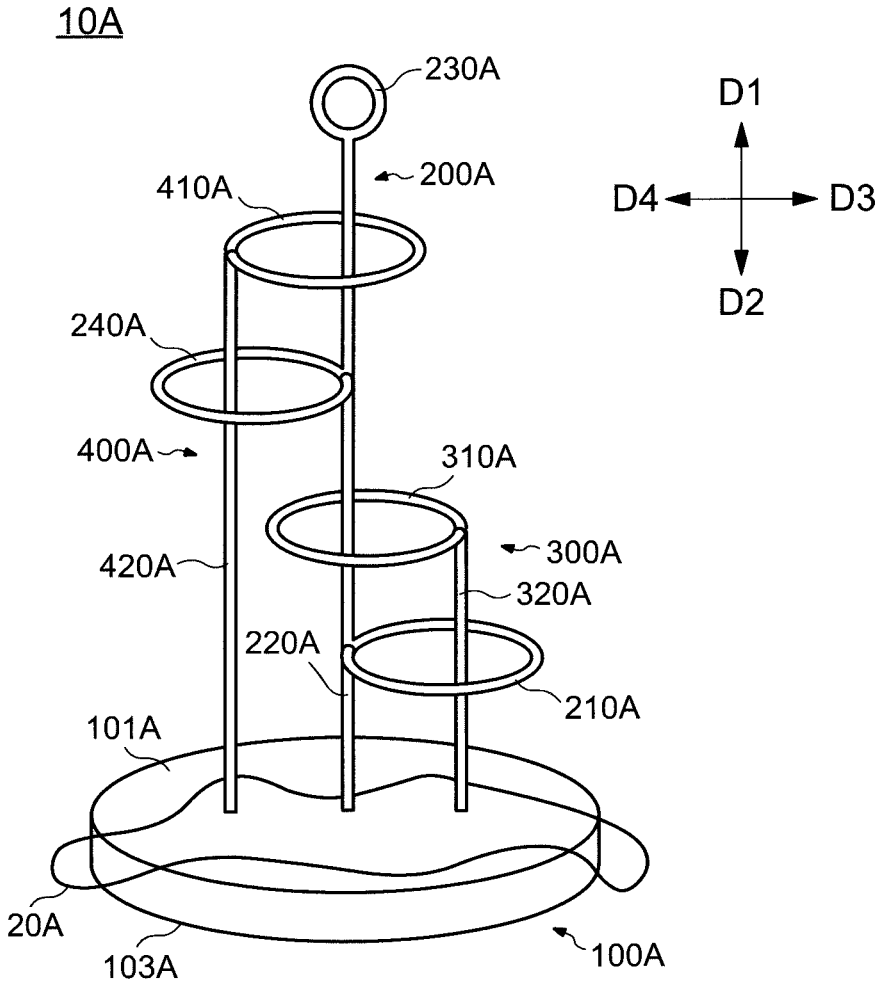
FIG. 1B is a diagram showing a structure of a wisdom ring puzzle according to an embodiment of the present invention.
Figure 2:
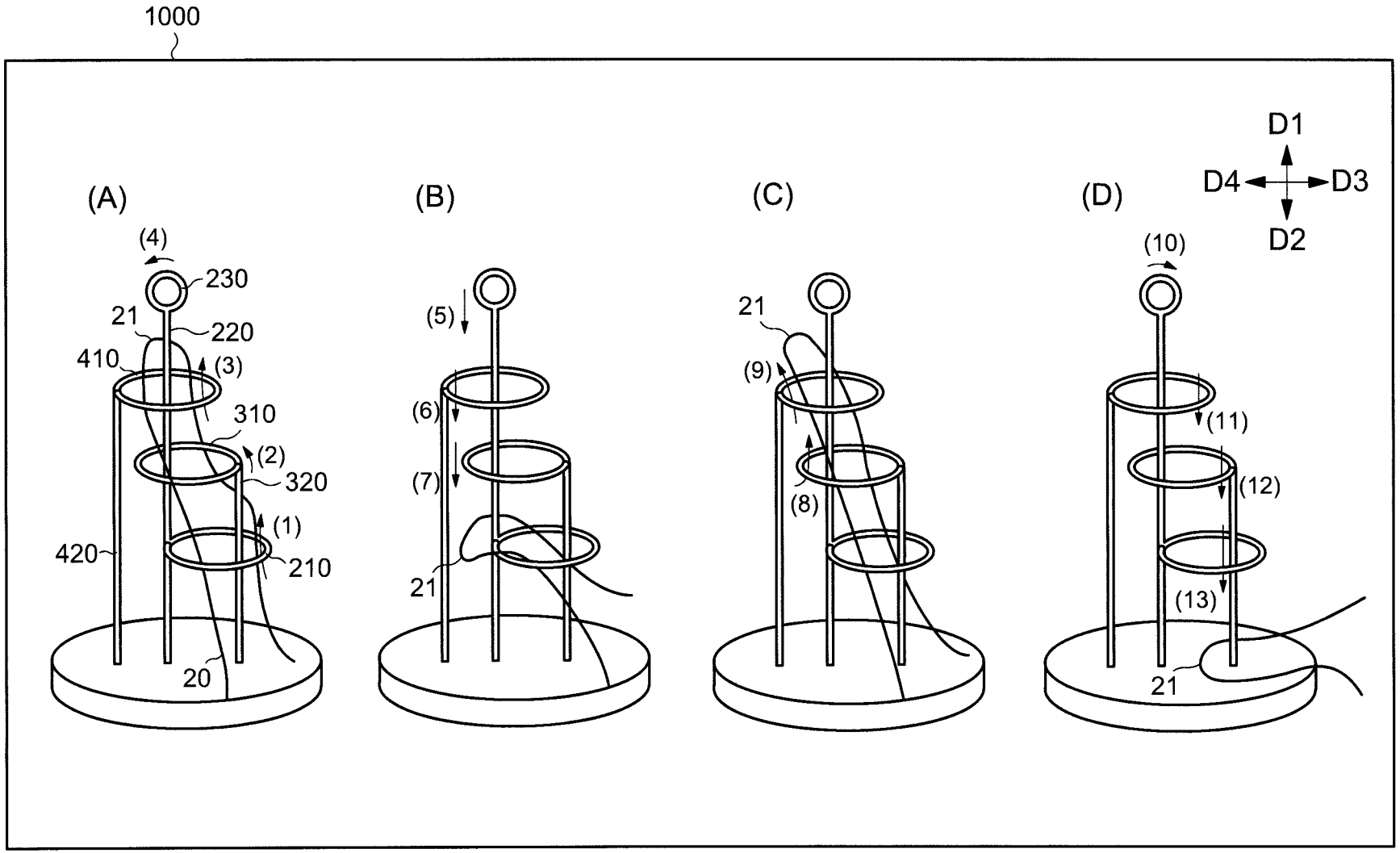
FIG. 2 is a diagram showing a method of solving a wisdom ring puzzle according to an embodiment of the present invention.
Figure 3:
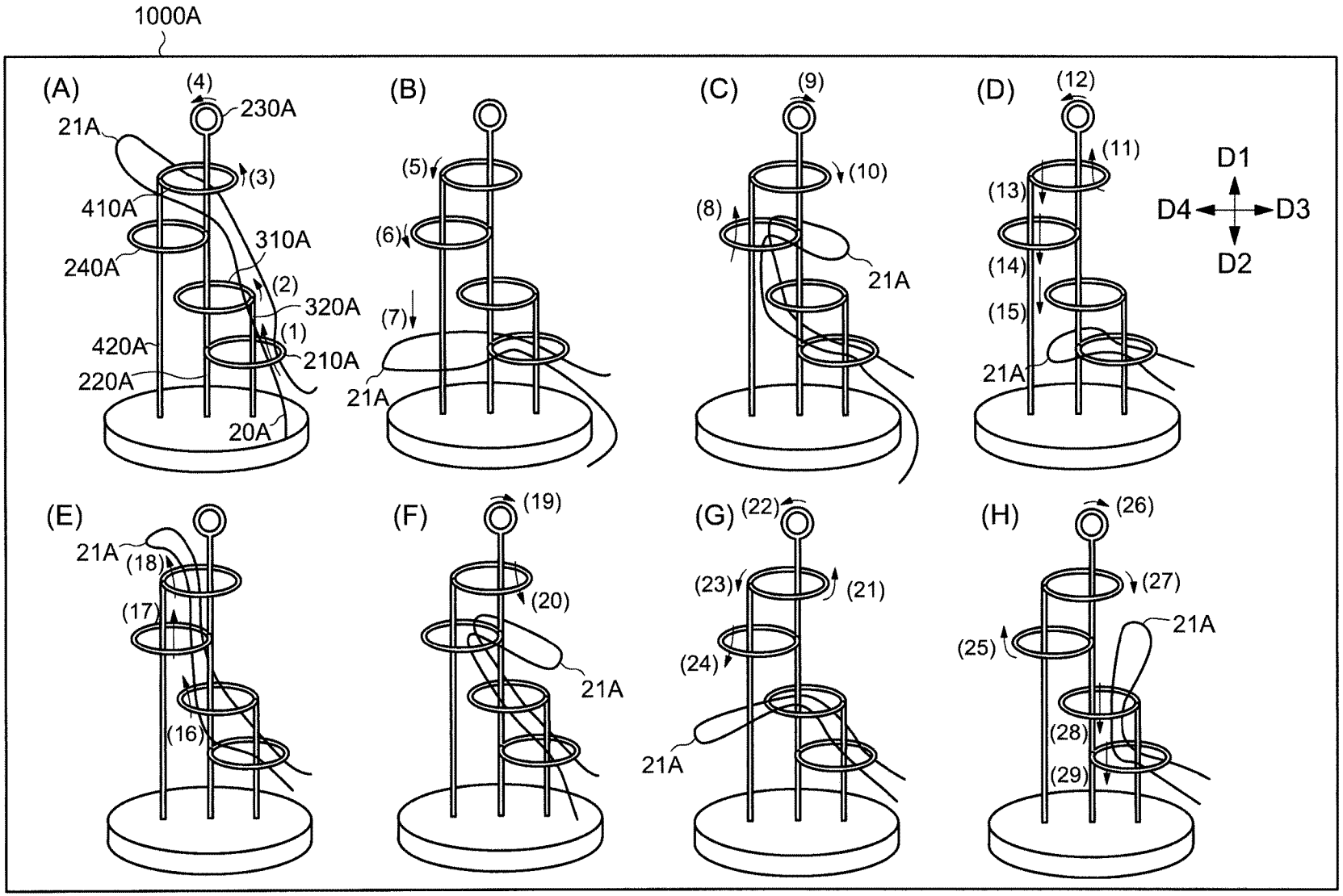
FIG. 3 is a diagram showing a method of solving a wisdom ring puzzle according to an embodiment of the present invention.

Wisdom ring puzzles 10 and 10A according to a first embodiment of the present invention will be described with reference to FIG. 1A to FIG. 3. FIG. 1A and FIG. 1B are diagrams illustrating structures of wisdom ring puzzles according to embodiments of the present invention. FIG. 2 and FIG. 3 are diagrams showing a method 1000 and 1000A of solving a wisdom ring puzzle according to an embodiment of the present invention. As will be described later, the wisdom ring puzzles 10 and 10A are puzzles using laces 20 and 20A. The player enjoys the wisdom ring puzzles 10 and 10A by entangling the laces 20 and 20A with poles (for example, second poles 320 and 320A) arranged on the wisdom ring puzzles 10 and 10A or removing the laces 20 and 20A from the poles.

[1-1. Structure of Wisdom Ring Puzzle 10]

As shown in FIG. 1A, the wisdom ring puzzle 10 includes the stage 100, the first structure body 200, a second structure body 300, and a third structure body 400. The lace 20 is used to play with the wisdom ring puzzle 10. In the present embodiment, although the lace 20 has a closed loop shape, it is not limited to this configuration.

The stage 100 includes an upper surface 101 and a bottom surface 103. The first structure body 200, the second structure body 300, and the third structure body 400 are connected to the upper surface 101. The bottom surface 103 is a surface that can be placed on a flat surface such as a table. In the present embodiment, the stage 100 has a circular flat plate shape in a plan view. However, the shape of the stage 100 in a plan view is not limited to a circular shape. For example, the shape of the stage 100 in a plan view may be a polygon such as a triangle or a quadrangle or may be an ellipse or a looped curved shape. In addition, the upper surface 101 and the bottom surface 103 are not limited to a flat surface and may be a structure in which unevenness is arranged.

The first structure body 200 includes a first ring unit 210 and a first pole 220. The first ring unit 210 is arranged on a first virtual plane substantially parallel to the upper surface 101. The first pole 220 is connected to the first ring unit 210 and extends in a direction orthogonal to the first virtual plane. The first pole 220 extends in direction D1 and direction D2 from the first ring unit 210. The first pole 220 is connected to an end portion of the first ring unit 210 in direction D4. A top portion 230 is arranged at the uppermost portion of the first pole 220. The top portion 230 has a ring shape.

The second structure body 300 includes a second ring unit 310 and the second pole 320. The second ring unit 310 is arranged on a second virtual plane substantially parallel to the upper surface 101. The second pole 320 is connected to the second ring unit 310 and extends in a direction orthogonal to the second virtual plane. The second pole 320 is connected to an end portion of the second ring unit 310 in direction D3. In other words, the second ring unit 310 is arranged at the uppermost portion of the second pole 320.

The third structure body 400 includes a third ring unit 410 and a third pole 420. The third ring unit 410 is arranged on a third virtual plane substantially parallel to the upper surface 101. The third pole 420 is connected to the third ring unit 410 and extends in a direction orthogonal to the third virtual plane. The third pole 420 is connected to an end portion of the third ring unit 410 in the direction D4. In other words, the third ring unit 410 is arranged at the uppermost portion of the third pole 420.

The first ring unit 210 is positioned in the direction D1 with respect to the stage 100. The second ring unit 310 is positioned in the direction D1 with respect to the first ring unit 210. The third ring unit 410 is positioned in the direction D1 with respect to the second ring unit 310. As described above, in the present embodiment, each of the first virtual plane on which the first ring unit 210 is arranged, the second virtual plane on which the second ring unit 310 is arranged, and the third virtual plane on which the third ring unit 410 is arranged is substantially parallel to each other and is substantially parallel to the upper surface 101. However, the present invention is not limited to the above configuration. For example, at least one of the first virtual plane to the third virtual plane may not be parallel to the other virtual planes.

A portion of the first pole 220 extending in the direction D2 from the first ring unit 210 is connected to the stage 100. A portion of the first pole 220 extending in the direction D1 from the first ring unit 210 passes through the inner side of the second ring unit 310 and the inner side of the third ring unit 410 and is connected to the top portion 230. The second pole 320 extending in the direction D2 from the second ring unit 310 passes through the inner side the first ring unit 210 and is connected to the stage 100. The third pole 420 extending in the direction D2 from the third ring unit 410 crosses over the outer side of the second ring unit 310 and the outer side of the first ring unit 210 and is connected to the stage 100. That is, the third pole 420 does not pass through the inner side of each of the second ring unit 310 and the first ring unit 210.

In a plan view, the first pole 220 is connected to the stage 100 at the inner side of the second ring unit 310 and at the inner side of the third ring unit 410. In a plan view, the second pole 320 is connected to the stage 100 at the inner side of the first ring unit 210. In a plan view, the third pole 420 is connected to the stage 100 at the outer side of each of the second ring unit 310 and the first ring unit 210. However, the positional relationship between each pole and each ring unit in a plan view is not limited to the above configuration.

In the present embodiment, although the configuration in which the first virtual plane, the second virtual plane, and the third virtual plane corresponding to each of the first ring unit 210, the second ring unit 310, and the third ring unit 410 are substantially parallel to the upper surface 101 is exemplified, the configuration is not limited to this configuration. For example, at least one of the first virtual plane, the second virtual plane, and the third virtual plane may not be parallel to the upper surface 101. For example, at least one of the first virtual plane, the second virtual plane, and the third virtual plane may be inclined with respect to the upper surface 101 or may be orthogonal with respect to the upper surface 101. The first ring unit 210, the second ring unit 310, and the third ring unit 410 may not be arranged on a plane.

In the present embodiment, although the configuration in which the first pole 220, the second pole 320, and the third pole 420 have linear shapes in the direction D1 and the direction D2 is exemplified, the configuration is not limited to this configuration. For example, the poles may have a partially bent shape or curved shape.

In the present embodiment, although the configuration in which the second ring unit 310 and the third ring unit 410 are arranged at the uppermost portions of the second pole 320 and the third pole 420, respectively, is exemplified, the configuration is not limited to this configuration. The second pole 320 may protrude from the second ring unit 310 in the direction D1, and the third pole 420 may protrude from the third ring unit 410 in the direction D1. In this case, a member similar to the top portion 230 may be arranged at the uppermost portion of each of the second pole 320 and the third pole 420. Also, the shape of the top portion 230 is not limited to a ring shape, and various shapes can be adopted. The top portion 230 is preferably shaped so as not to injure the player. For example, the top portion 230 may have a sphere-shape or an object with motifs of a doll, an animal, or the like, and the top portion 230 may have various shapes.

A position where the first support 220 is connected to the first ring unit 210 is not limited to the above position. Similarly, a position where the second pole 320 is connected to the second ring unit 310 and a position where the third pole 420 is connected to the third ring unit 410 are not limited to the above positions.

In the present embodiment, the first ring unit 210, the second ring unit 310, and the third ring unit 410 are contiguous with the first pole 220 (a portion extending in the direction D2 from the first ring unit 210), the second pole 320, and the third pole 420, respectively. For example, the third ring unit 410 is formed such that the third pole 420 is bent and forms a ring shape on the first virtual plane. Therefore, in the wisdom ring puzzle 10 according to the present embodiment, each ring unit is not a completely closed loop shape without a gap but may be a closed loop shape without a gap. Also, even when a gap is arranged in each ring unit in the present embodiment, the width of the gap is such that the lace 20 does not pass therethrough. Also, the ring unit and the pole may be separate members, and they may be joined to each other by welding or the like.

In the present embodiment, a portion of the first pole 220 extending in the direction D1 from the first ring unit 210 is made of a member different from the first ring unit 210. However, these may be integrally configured. Also, the first pole 220 may be configured by a pole connected to the first ring unit 210 and extending in the direction D2 from the first ring unit 210 and connected to the stage 100, and a pole connected to the top portion 230 and extending in the direction D2 from the top portion 230 and connected to the stage 100. Alternatively, the first ring unit 210 formed separately from the first pole 220 may be joined to the first pole 220 by, for example, welding or the like with respect to the first pole 220 that is contiguous from the top portion 230 to the stage 100.

[1-2. Structure of Wisdom Ring Puzzle 10A]

As shown in FIG. 1B, a wisdom ring puzzle 10A includes a stage 100A, a first structure body 200A, a second structure body 300A, and a third structure body 400A. Although the wisdom ring puzzle 10A shown in FIG. 1B is similar to the wisdom ring puzzle 10 shown in FIG. 1A, the first structure body 200A is different from the first structure body 200 of the wisdom ring puzzle 10. In the following description, differences between the wisdom ring puzzle 10 and the wisdom ring puzzle 10A will be mainly explained. In the following description, in the case of describing the same configuration as the wisdom ring puzzle 10, the description may be omitted by adding the letter "A" after the symbols shown in FIG. 1A.

As shown in FIG. 1B, the first structure body 200A further includes a fourth ring unit 240A in addition to a first ring unit 210A. The fourth ring unit 240A is arranged on a fourth virtual plane substantially parallel to an upper surface 101A. The fourth ring unit 240A is arranged in the direction D1 with respect to the first ring unit 210A and is arranged between a second ring unit 310A and a third ring unit 410A in the direction D1. A first pole 220A is connected to an end portion of the fourth ring unit 240A. A third pole 420A passes through the inner side of the fourth ring unit 240A, crosses over the outer side of the second ring unit 310A and the outer side of the first ring unit 210A, and is connected to the stage 100A.

In the present embodiment, although a configuration in which the fourth virtual plane corresponding to the fourth ring unit 240A is substantially parallel to the upper surface 101A is exemplified, the configuration is not limited to this configuration. For example, the fourth virtual plane may not be parallel to the upper surface 101A. For example, the fourth virtual plane may be inclined with respect to the upper surface 101A or may be orthogonal to the upper surface 101A.

[1-3. Method of Solving Wisdom Ring Puzzle 10]

A method 1000 of solving the wisdom ring puzzle 10 shown in FIG. 1A will be described with reference to FIG. 2. The lace 20 is used to play with the wisdom ring puzzle 10. The player moves the lace 20 along the poles (the first pole 220 to the third pole 420) arranged on the first structure body 200 to the third structure body 400 and moves the lace 20 between the poles by passing it through the inner side of the ring units (the first ring unit 210 to the third ring unit 410) or crossing it over the outer side of the ring units. Then, in the present embodiment, the player aims for a state in which the lace 20 is entangled only with the second pole 320. That is, the wisdom ring puzzle 10 according to the present embodiment is a puzzle that aims for a state in which only the second pole 320 exists at the inner side the lace 20.

As shown in (A) of FIG. 2, the lace 20 moves in the direction D1 along the second pole 320, passes through the inner side of the first ring unit 210 in the direction D1 (1), crosses over the outer side (direction D3 side) of the second ring unit 310 in the direction D1 (2), moves in the direction D1 along the first pole 220, passes through the inner side of the third ring unit 410 in the direction D1 (3), and crosses over the top portion 230 in the direction D4 (4). In this state, the lace 20 sandwiches the second pole 320 at the inner side the first ring unit 210, is positioned at the outer side the second ring unit 310, and sandwiches the first pole 220 at the inner side the third ring unit 410.

As shown in (B) of FIG. 2, a tip 21 of the lace 20 moves in the direction D2 along the first pole 220 (5), passes through the inner side of the third ring unit 410 in the direction D2 (6), and passes through the outer side (direction D4 side) of the second ring unit 310 in the direction D2 (7). In this state, the lace 20 hangs on the first ring unit 210 and hangs down on a side (direction D4 side) opposite to the first ring unit 210 with respect to the first pole 220.

As shown in (C) of FIG. 2, the tip 21 of the lace 20 moves in the direction D1 along the first pole 220, passes through the inner side of the second ring unit 310 in the direction D1 (8), and passes through the inner side of the third ring unit 410 in the direction D1 (9). In this state, the lace 20 sandwiches the second pole 320 at the inner side the first ring unit 210, sandwiches the first pole 220 at the inner side of the second ring unit 310, and sandwiches the first pole 220 at the inner side of the third ring unit 410.

As shown in (D) of FIG. 2, the tip 21 of the lace 20 crosses over the top portion 230 in the direction D3 (10), moves in the direction D2 along the first pole 220, passes through the inner side of the third ring unit 410 in the direction D2 (11), passes through the inner side of the second ring unit 310 in the direction D2 (12), and passes through the inner side of the first ring unit 210 in the direction D2 (13). As a result, the lace 20 is in a state of being entangled only with the second pole 320. In this state, only the second pole 320 exists at the inner side of the lace 20. That is, this state is a state in which the puzzle is solved.

[1-4. Method of Solving Wisdom Ring Puzzle 10A]

A method 1000A of solving the wisdom ring puzzle 10A shown in FIG. 1B will be described with reference to FIG. 3. The wisdom ring puzzle 10A is a puzzle targeting a state in which a lace 20A is entangled only with the second pole 320A (a state in which only the second pole 320A exists at the inner side of the lace 20A) similar to the wisdom ring puzzle 10.

As shown in (A) of FIG. 3, a tip 21A of the lace 20A moves in the direction D1 along the second pole 320A, passes through the inner side of the first ring unit 210A in the direction D1 (1), crosses over the outer side (direction D3 side) of the second ring unit 310A in the direction D1 (2), moves in the direction D1 along the first pole 220A, crosses over the outer side (direction D3 side) of the third ring unit 410A in the direction D1 (3), and crosses over a top portion 230A in the direction D4 (4).

As shown in (B) of FIG. 3, the tip 21A of the lace 20A moves in the direction D2 along the first pole 220A, crosses over the outer side (direction D4 side) of the third ring unit 410A in the direction D2 (5), moves in the direction D2 along the third pole 420A, crosses over the outer side (direction D4 side) of the fourth ring unit 240A in the direction D2 (6), and moves in the direction D2 along the third pole 420A (7). In this state, the lace 20A hangs on the first ring unit 210A and sandwiches the third pole 420A on a side (direction D4 side) opposite to the first ring unit 210A with respect to the first pole 220A.

As shown in (C) of FIG. 3, the tip 21A of the lace 20A moves in the direction D1 along the third pole 420A, passes through the inner side of the fourth ring unit 240A in the direction D1 (8), moves in the direction D1 along the third pole 420A and the first pole 220A, and crosses over the top portion 230A in the direction D3 (9). Thereafter, the tip 21A moves in the direction D2 along the first pole 220A and crosses over the outer side of the third ring unit 410A (direction D3 side) in the direction D2 (10). In this state, the lace 20A hangs on the fourth ring unit 240A and hangs down on a side (direction D3 side) opposite to the fourth ring unit 240A with respect to the first pole 220A.

As shown in (D) of FIG. 3, the tip 21A of the lace 20A moves in the direction D1 along the first pole 220A, passes through the inner side of the third ring unit 410A in the direction D1 (11), and crosses over the top portion 230A in the direction D4 (12). Thereafter, the tip 21A moves in the direction D2 along the first pole 220A, passes through the inner side of the third ring unit 410A in the direction D2 (13), passes through the inner side of the fourth ring unit 240A in the direction D2 (14), and crosses over the outer side (direction D4 side) of the second ring unit 310A in the direction D2 (15). In this state, the lace 20A hangs on the first ring unit 210A and hangs down on a side (direction D4 side) opposite to the first ring unit 210A with respect to the first pole 220A.

As shown in (E) of FIG. 3, the tip 21A of the lace 20A moves in the direction D1 along the first pole 220A, passes through the inner side of the second ring unit 310A in the direction D1 (16), passes through the inner side of the fourth ring unit 240A in the direction D1 (17), and passes through the inner side of the third ring unit 410A in the direction D1 (18). In this state, the lace 20A passes through all of the inner sides of the first ring unit 210A, the second ring unit 310A, the third ring unit 410A, and the fourth ring unit 240A.

As shown in (F) of FIG. 3, the tip 21A of the lace 20A moves in the direction D1 along the first pole 220A and crosses over the top portion 230A in the direction D3 (19). Thereafter, the tip 21A moves in the direction D2 along the first pole 220A and passes through the inner side of the third ring unit 410A in the direction D2 (20). In this state, the lace 20A hangs on the fourth ring unit 240A and hangs down on a side (direction D3 side) opposite to the fourth ring unit 240A with respect to the first pole 220A.

As shown in (G) of FIG. 3, the tip 21A of the lace 20A moves in the direction D1 along the first pole 220A, crosses over the outer side (direction D3 side) of the third ring unit 410A in the direction D1 (21), and crosses over the top portion 230A in the direction D4 (22). Thereafter, the tip 21A moves in the direction D2 along the first pole 220A, crosses over the outer side (direction D4 side) of the third ring unit 410A in the direction D2 (23), moves in the direction D2 along the third pole 420A, and passes through the inner side of the fourth ring unit 240A in the direction D2 (24). In this state, the lace 20A hangs on the second ring unit 310A and sandwiches the third pole 420A on a side (direction D4 side) opposite to the first ring unit 210A with respect to the first pole 220A.

As shown in (H) of FIG. 3, the tip 21A of the lace 20A moves in the direction D1 along the third pole 420A, crosses over the outer side (direction D4 side) of the fourth ring unit 240A in the direction D1 (25), moves in the direction D1 along the third pole 420A and the first pole 220A, and crosses over the top portion 230A in the direction D3 (26). Thereafter, as the tip 21A moves in the direction D2 along the first pole 220A, crosses over the outer side (direction D3 side) of the third ring unit 410A in the direction D2 (27), passes through the inner side of the second ring unit 310A in the direction D2 (28), and passes through the inner side of the first ring unit 210A in the direction D2 (29), the lace 20A is in a state of being entangled only with the second pole 320A (a state in which the puzzle is solved). In this state, only the second pole 320A exists at the inner side of the lace 20A.

2. Second Embodiment

Figure 4A:
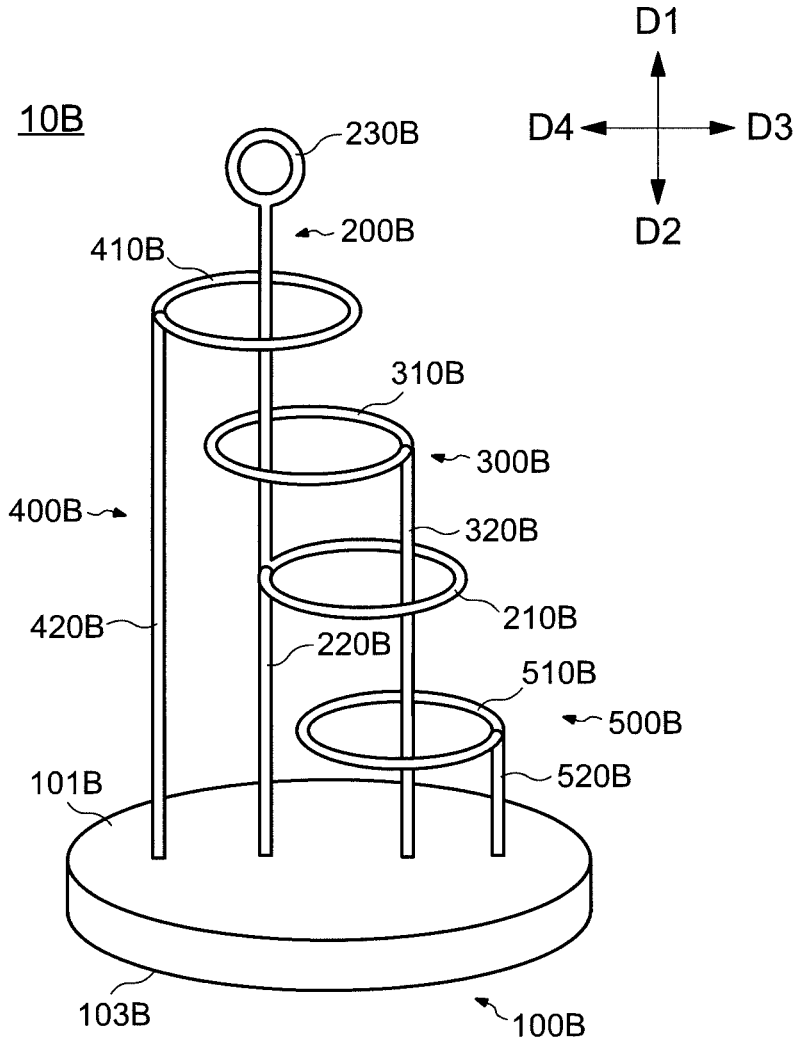
FIG. 4A is a diagram showing a structure of a wisdom ring puzzle according to an embodiment of the present invention.
Figure 4B:
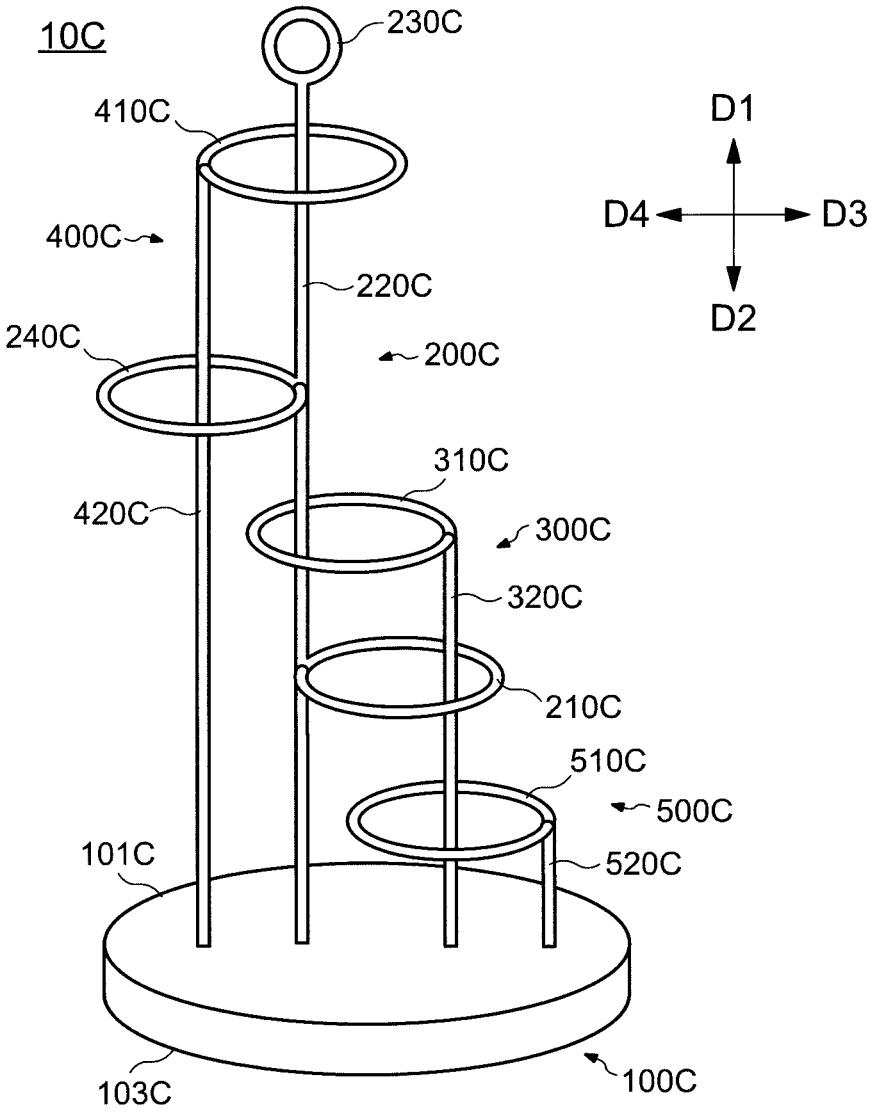
FIG. 4B is a diagram showing a structure of a wisdom ring puzzle according to an embodiment of the present invention.
Figure 5:
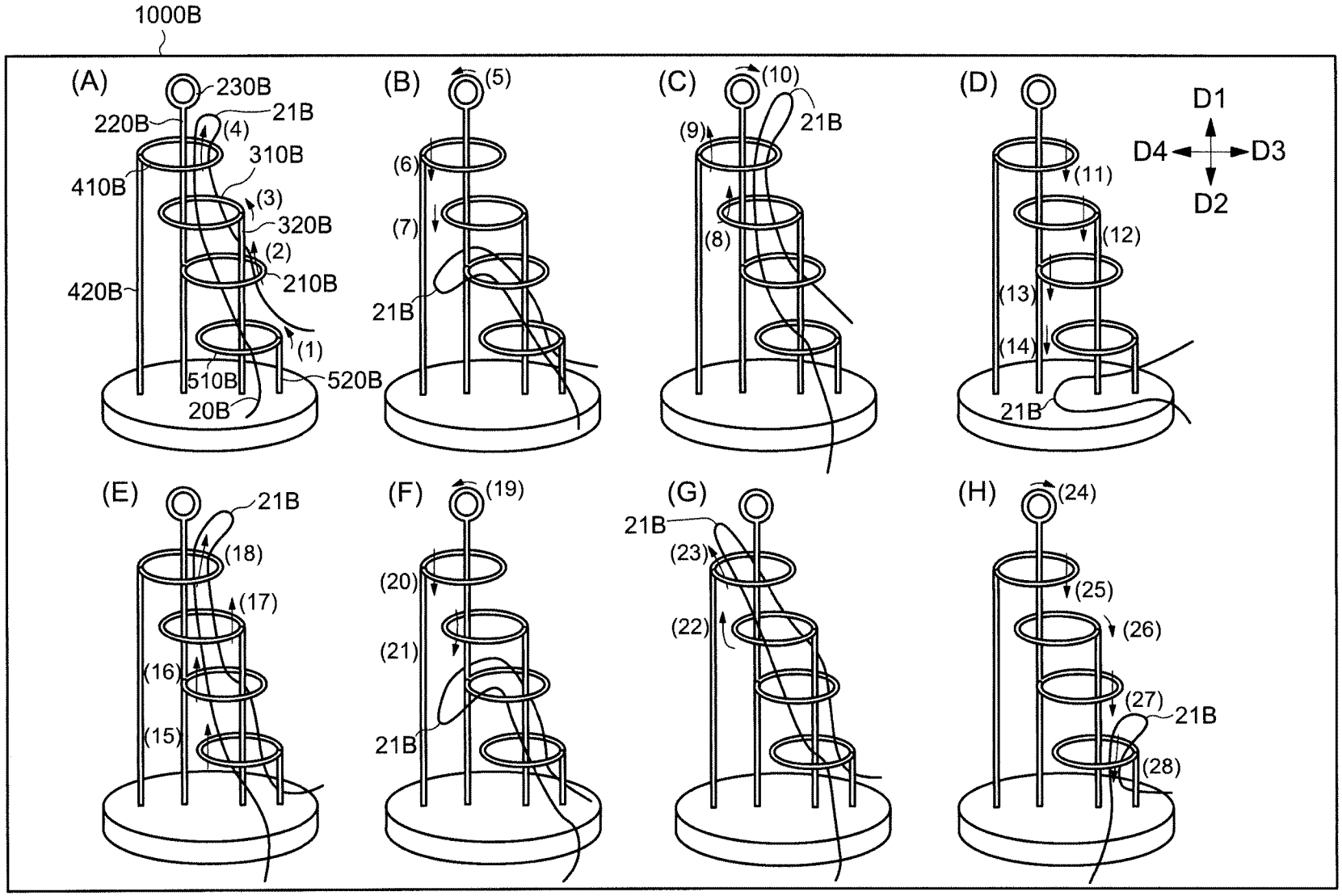
FIG. 5 is a diagram showing a method of solving a wisdom ring puzzle according to an embodiment of the present invention.
Figure 6:
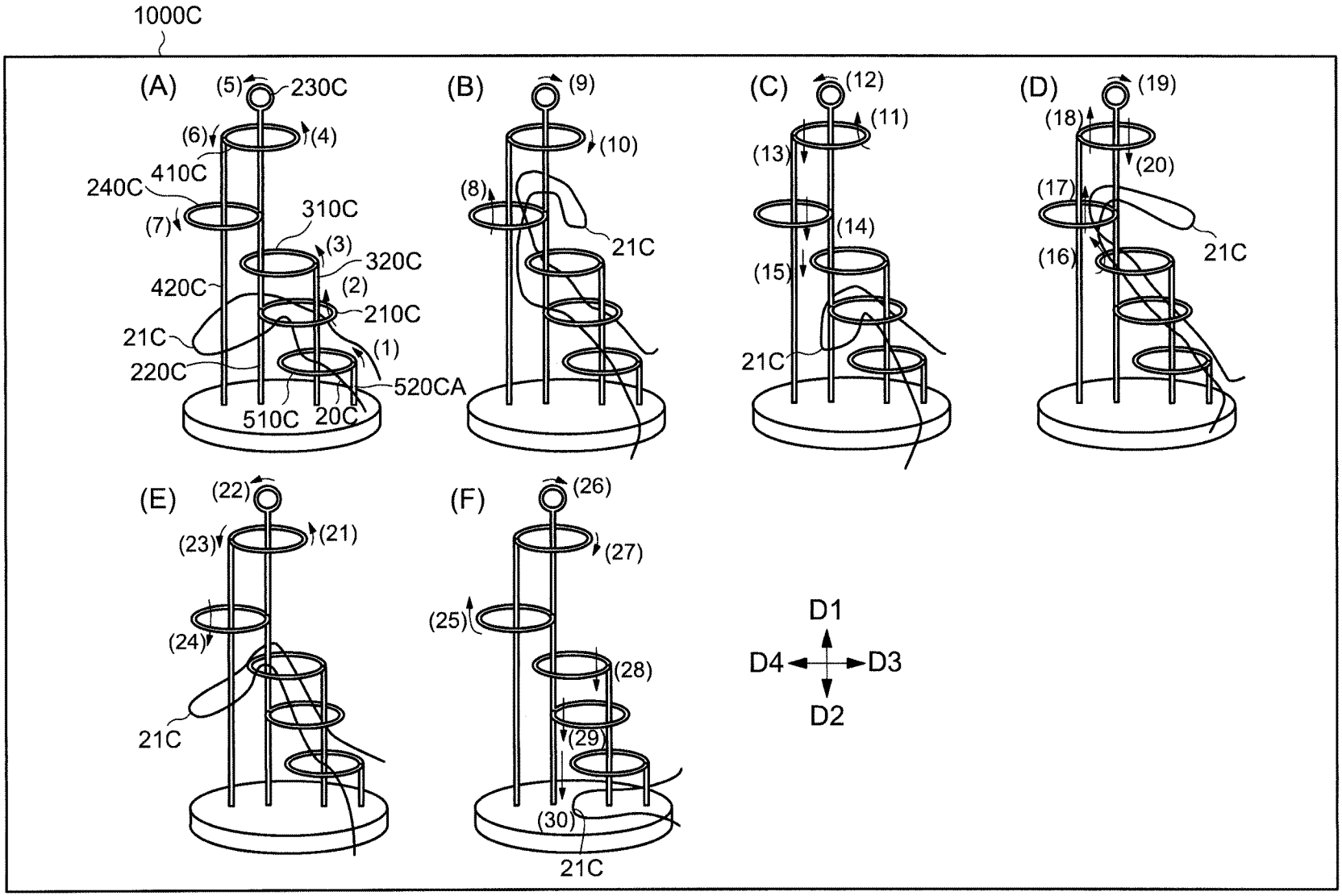
FIG. 6 is a diagram showing a method of solving a wisdom ring puzzle according to an embodiment of the present invention.
Figure 7:
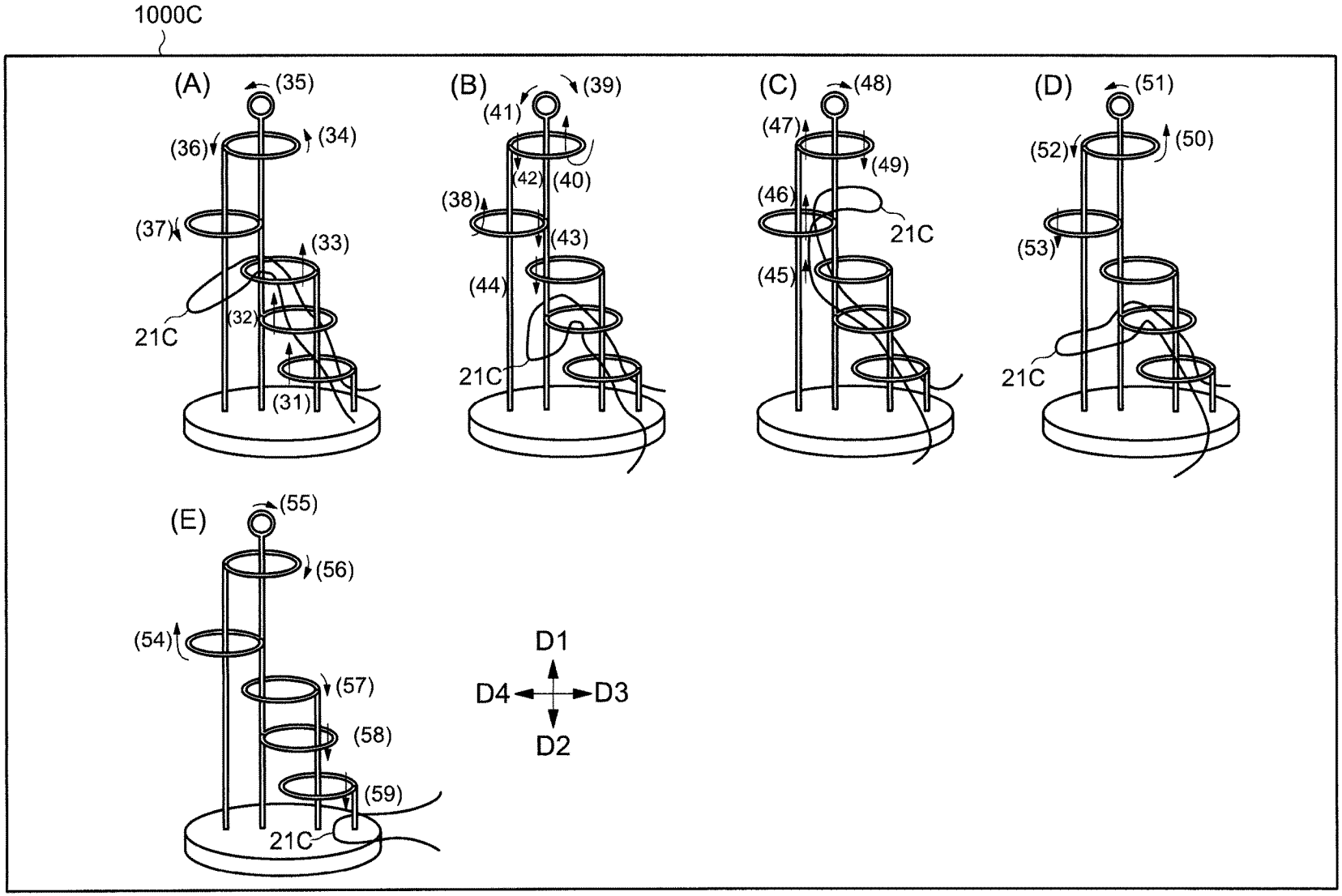
FIG. 7 is a diagram showing a method of solving a wisdom ring puzzle according to an embodiment of the present invention.

Wisdom ring puzzles 10B and 100 according to the second embodiment will be described with reference to FIG. 4A to FIG. 7. FIG. 4A and FIG. 4B are diagrams illustrating structures of wisdom ring puzzles according to an embodiments of the present invention. FIG. 5 to FIG. 7 are diagrams illustrating a method 1000B and 1000C of solving a wisdom ring puzzle according to an embodiment of the present invention. Similar to the first embodiment, the wisdom ring puzzles 10B and 100 are puzzles using laces 20B and 20C (not shown). The player enjoys the wisdom ring puzzles 20B and 20C by entangling the laces 10B and 10C with poles (for example, fifth poles 520B and 520C) arranged on the wisdom ring puzzles 10B and 100 or removing the laces 20B and 20C from the poles. In the following description, description of the same configuration as that of the wisdom ring puzzle 10 of the first embodiment will be omitted. In the following description, in the case of describing the same configuration as the wisdom ring puzzle 10, the description may be emitted by adding the letter "B" after the symbols shown in FIG. 1A or adding the letter "C" instead of the letter "A" after the symbols shown in FIG. 1B.

[2-1. Structure of Wisdom Ring Puzzle 10B]

As shown in FIG. 4A, the wisdom ring puzzle 10B includes a stage 100B, a first structure body 200B, a second structure body 300B, a third structure body 400B, and a fifth structure 500B. The configurations of the first structure body 200B, the second structure body 300B, and the third structure body 400B shown in FIG. 4A are the same as the configurations of the first structure body 200, the second structure body 300, and the third structure body 400 shown in FIG. 1A, and the description will be omitted.

The fifth structure 500B includes a fifth ring unit 510B and the fifth pole 520B. The fifth ring unit 510B is arranged on a fifth virtual plane substantially parallel to an upper surface 101B. The fifth pole 520B is connected to the fifth ring unit 510B and extends in a direction orthogonal to the fifth virtual plane. The fifth pole 520B is connected to an end portion of the fifth ring unit 510B in the direction D3. The fifth ring unit 510B is arranged at the uppermost portion of the fifth pole 520B.

The fifth ring unit 510B is positioned in the direction D1 with respect to the stage 100B and the direction D2 with respect to a first ring unit 210B. That is, the fifth ring unit 510B is positioned between the stage 100B and the first ring unit 210B. As described above, in the present embodiment, the fifth virtual plane on which the fifth ring unit 510B is arranged is substantially parallel to the first virtual plane to the third virtual plane. However, the present invention is not limited to the above configuration. For example, the fifth virtual plane may not be parallel to the first virtual plane to the third virtual plane.

A first pole 220B extending in the direction D2 from the first ring unit 2108 crosses over the outer side of the fifth ring unit 5108 and is connected to the stage 1008. That is, the first pole 220B does not pass through the inner side of the fifth ring unit 5108. A second pole 320B extending in the direction D2 from a second ring unit 310B passes through the inner side of the first ring unit 2108 and the inner side of the fifth ring unit 5108 and is connected to the stage 1008. A third pole 420B extending in the direction D2 from a third ring unit 410B crosses over the outer side of the second ring unit 310B, the outer side of the first ring unit 210B, and the outer side of the fifth ring unit 5108, and is connected to the stage 1008. That is, the third pole 420B does not pass through the inner side of each of the second ring unit 310B, the first ring unit 210B, and the fifth ring unit 5108.

In a plan view, the first pole 220B is connected to the stage 1008 on the inner side of the second ring unit 3108 and on the inner side of the third ring unit 410B and on the outer side of the fifth ring unit 5108. In a plan view, the second pole 320B is connected to the stage 1008 at the inner side of the first ring unit 210B and the inner side the fifth ring unit 5108. In a plan view, the third pole 420B is connected to the stage 100B on the outer side of each of the second ring unit 310B, the first ring unit 210B, and the fifth ring unit 5108. However, the positional relationship between the poles and ring units in a plan view is not limited to the above configuration.

In the present embodiment, although the configuration in which the fifth virtual plane corresponding to the fifth ring unit 510B is substantially parallel to the upper surface 101B is exemplified, the configuration is not limited to this configuration. For example, the fifth virtual plane may not be parallel to the upper surface 101B. For example, the fifth virtual plane may be inclined with respect to the upper surface 101B or may be orthogonal to the upper surface 101B.

In the present embodiment, although the configuration in which the fifth pole 520B has a linear shape in the direction D1 and the direction D2 is exemplified, the configuration is not limited to this configuration. For example, the fifth pole 520B may have a partially bent shape or curved shape.

In the present embodiment, although the configuration in which the fifth ring unit 510B is arranged at the uppermost portion of the fifth pole 520B is exemplified, the configuration is not limited to this configuration. The fifth pole 520B may protrude in the direction D1 from the fifth ring unit 510B. In this case, a member similar to a top portion 230B may be arranged at the uppermost portion of the fifth pole 520B.

In the present embodiment, the fifth ring unit 510B is contiguous with the fifth pole 520B. For example, the fifth ring unit 510B is formed such that the fifth pole 520B is bent and forms a ring shape on the fifth virtual plane. Therefore, in the wisdom ring puzzle 10B according to the present embodiment, each ring unit is not a completely closed loop shape without a gap but may be a closed loop shape without a gap. Also, even when a gap is arranged in each ring unit in the present embodiment, the width of the gap is a width such that the lace 20B does not pass therethrough. Also, the ring unit and the pole may be separate members, and they may be joined to each other by welding or the like.

[2-2. Structure of Wisdom Ring Puzzle 100]

As shown in FIG. 4B, the wisdom ring puzzle 100 includes a stage 100C, a first structure body 200C, a second structure body 300C, a third structure body 400C, and a fifth structure body 500C. Although the wisdom ring puzzle 100 shown in FIG. 4B is similar to the wisdom ring puzzle 10 shown in FIG. 4A, the first structure body 200C is different from the first structure body 200B of the wisdom ring puzzle 10B. In the following description, the difference between the wisdom ring puzzle 10B and the wisdom ring puzzle 10C will be mainly explained. In the following description, in the case of describing the same configuration as the wisdom ring puzzle 10B, the description may be omitted by adding the letter "C" instead of the letter "B" after the symbols shown in FIG. 4A.

As shown in FIG. 4B, the first structure body 200C further includes a fourth ring unit 240C in addition to a first ring unit 210C. The fourth ring unit 240C is arranged on the fourth virtual plane substantially parallel to an upper surface 101C. The fourth ring unit 240C is arranged in the direction D1 with respect to the first ring unit 210C and is arranged between a second ring unit 310C and a third ring unit 410C in the direction D1. A first pole 220C is connected to an end portion of the fourth ring unit 240C in the direction D3. A third pole 420C passes through the inner side of the fourth ring unit 240C, crosses over the outer side of the second ring unit 310C, the outer side of the first ring unit 210C, and the outer side of a fifth ring unit 510C, and is connected to the stage 100C.

[2-3. Method of Solving Wisdom Ring Puzzle 10B]

A method 1000B of solving the wisdom ring puzzle 10B shown in FIG. 4A will be described with reference to FIG. 5. Unlike the wisdom ring puzzle 10 shown in FIG. 1A, the wisdom ring puzzle 10B is a puzzle targeting a state in which the lace 20B is entangled only with the fifth pole 520B (a state in which only the fifth pole 520B exists at the inner side of the lace 20B).

As shown in (A) of FIG. 5, a tip 21B of the lace 20B moves in the direction D1 along the fifth pole 520B, crosses over the outer side (direction D3 side) of the fifth ring unit 510B in the direction D1 (1), moves in the direction D1 along the second pole 320B, passes through the inner side of the first ring unit 210B in the direction D1 (2), crosses over the outer side (direction D3 side) of the second ring unit 310B in the direction D1 (3), moves in the direction D1 along the first pole 220B, and passes through the inner side of the third ring unit 410B in the direction D1 (4). In this state, the lace 20B is positioned at the outer side of the fifth ring unit 510B, sandwiches the second pole 320B at the inner side of the first ring unit 210B, and is positioned at the outer side of the second ring unit 310B.

As shown in (B) of FIG. 5, the tip 21B of the lace 20B moves in the direction D1 along the first pole 220B and crosses over the top portion 230B in the direction D4 (5). Thereafter, the tip 21B moves in the direction D2 along the first pole 220B, passes through the inner side of the third ring unit 410B in the direction D2 (6), and crosses over the outer side (direction D4 side) of the second ring unit 310B in the direction D2 (7). In this state, the lace 20B hangs on the first ring unit 210B and hangs down on a side (direction D4 side) opposite to the first ring unit 210B with respect to the first pole 220B.

As shown in (C) of FIG. 5, the tip 21B of the lace 20B moves in the direction D1 along the first pole 220B, passes through the inner side of the second ring unit 310B in the direction D1 (8), passes through the inner side of the third ring unit 410B in the direction D1 (9), and crosses over the top portion 230B in the direction D3 (10). In this state, the lace 20B is positioned at the outer side of the fifth ring unit 510B, and is positioned at the inner side of the first ring unit 210B, the inner side of the second ring unit 310B, and the inner side of the third ring unit 410B.

As shown in (D) of FIG. 5, the tip 21B of the lace 20B moves in the direction D2 along the first pole 220B, passes through the inner side of the third ring unit 410B in the direction D2 (11), passes through the inner side of the second ring unit 310B in the direction D2 (12), passes through the inner side of the first ring unit 210B in the direction D2 (13), and crosses over the outer side (direction D4 side) of the fifth ring unit 510B in the direction D2 (14). As a result, the lace 20B is in a state of being entangled with the second pole 320B and the fifth pole 520B. In this state, only the second pole 320B and the fifth pole 520B exists at the inner side of the lace 20B.

As shown in (E) of FIG. 5, the tip 21B of the lace 20B moves in the direction D1 along the first pole 220B, passes through the inner side of the fifth ring unit 510B in the direction D1 (15), passes through the inner side of the first ring unit 210B in the direction D1 (16), passes through the inner side of the second ring unit 310B in the direction D1 (17), and passes through the inner side of the third ring unit 410B in the direction D1 (18). In this state, the lace 20B is positioned at the inner side of each of the first ring unit 210B, the second ring unit 310B, the third ring unit 410B, and the fifth ring unit 510B.

As shown in (F) of FIG. 5, the tip 21B of the lace 20B moves in the direction D1 along the first pole 220B and crosses over the top portion 230B in the direction D4 (19). Thereafter, the tip 21B moves in the direction D2 along the first pole 220B, passes through the inner side of the third ring unit 410B in the direction D2 (20), and passes through the inner side of the second ring unit 310B in the direction D2 (21). In this state, the lace 20B hangs on the first ring unit 210B and hangs down on a side (direction D4 side) opposite to the first ring unit 210B with respect to the first pole 220B.

As shown in (G) of FIG. 5, the tip 21B of the lace 20B moves in the direction D1 along the first pole 220B, crosses over the outer side (direction D4 side) of the second ring unit 310B in the direction D1 (22), and passes through the inner side of the third ring unit 410B in the direction D1 (23). In this state, the lace 20B is positioned at the outer side of the second ring unit 310B, and is positioned at the inner side of the first ring unit 210B, the inner side of the third ring unit 410B, and the inner side of the fifth ring unit 510B.

As shown in (H) of FIG. 5, the tip 21B of the lace 20B moves in the direction D1 along the first pole 220B and crosses over the top portion 230B in the direction D3 (24). Thereafter, the tip 21B of the lace 20B moves in the direction D2 along the first pole 220B, passes through the inner side of the third ring unit 410B in the direction D2 (25), crosses over the outer side (direction D3 side) of the second ring unit 310B in the direction D2 (26), moves in the direction D2 along the second pole 320B, passes through the inner side of the first ring unit 210B in the direction D2 (27), and passes through the inner side of the fifth ring unit 510B in the direction D2 (28). As a result, the lace 20B is in a state of being entangled only with the fifth pole 520B (a state in which the puzzle is solved). In this state, only the fifth pole 520B exists at the inner side of the lace 20B.

[2-4. Method of Solving Wisdom Ring Puzzle 100]

A method 1000C of solving the wisdom ring puzzle 100 shown in FIG. 4B will be described with reference to FIG. 6 to FIG. 7. The wisdom ring puzzle 100 is a puzzle targeting a state in which the lace 20C is entangled only with the fifth pole 520C (a state in which only the fifth pole 520C exists at the inner side of the lace 20C) similar to the wisdom ring puzzle 10B of FIG. 4A.

As shown in (A) of FIG. 6, a tip 21C of the lace 20C moves in the direction D1 along the fifth pole 520C, crosses over the outer side (direction D3 side) of the fifth ring unit 510C in the direction D1 (1), moves in the direction D1 along a second pole 320C, passes through the inner side of the first ring unit 210C in the direction D1 (2), crosses over the outer side (direction D3 side) of the second ring unit 310C in the direction D1 (3), moves in the direction D1 along the first pole 220C, crosses over the outer side (direction D3 side) of the third ring unit 410C in the direction D4 (4), and crosses over a top portion 230C in the direction D4 (5). Thereafter, the tip 21C moves in the direction D2 along the first pole 220C, crosses over the outer side of the third ring unit 410C (direction D4 side) in the direction D2, moves in the direction D2 along the third pole 420C, and crosses over the outer side (direction D4 side) of the fourth ring unit 240C (7). In this state, the lace 20C hangs on the first ring unit 210C and sandwiches the third pole 420C on a side (direction D4 side) opposite to the first ring unit 210C with respect to the first pole 220C.

As shown in (B) of FIG. 6, the tip 21C of the lace 20C moves in the direction D1 along the third pole 420C, passes through the inner side of the fourth ring unit 240C in the direction D1 (8), moves in the direction D1 along the third pole 420C and the first pole 220C, and crosses over the top portion 230C in the direction D3 (9). Thereafter, the tip 21C moves in the direction D2 along the first pole 220C and crosses over the outer side (direction D3 side) of the third ring unit 410C in the direction D2 (10). In this state, the lace 20C hangs on the fourth ring unit 240C and hangs down on a side (direction D3 side) opposite to the fourth ring unit 240C with respect to the first pole 220C.

As shown in (C) of FIG. 6, the tip 21C of the lace 20C moves in the direction D1 along the first pole 220C, passes through the inner side of the third ring unit 410C in the direction D1 (11), and crosses over the top portion 230C in the direction D4 (12). Thereafter, the tip 21C moves in the direction D2 along the first pole 220C, passes through the inner side of the third ring unit 410C in the direction D2 (13), passes through the inner side of the fourth ring unit 240C in the direction D2 (14), and crosses over the outer side (direction D4 side) of the second ring unit 310C in the direction D2 (15). In this state, the lace 20C hangs on the first ring unit 210C and hangs down on a side (direction D4 side) opposite to the first ring unit 210C with respect to the first pole 220C.

As shown in (D) of FIG. 6, the tip 21C of the lace 20C moves in the direction D1 along the first pole 220C, passes through the inner side of the second ring unit 310C in the direction D1 (16), passes through the inner side of the fourth ring unit 240C in the direction D1 (17), passes through the inner side of the third ring unit 410C in the direction D1 (18), and crosses over the top portion 230C in the direction D3 (19). Thereafter, the tip 21C moves in the direction D2 along the first pole 220C and passes through the inner side of the third ring unit 410C in the direction D2 (20). In this state, the lace 20C hangs on the fourth ring unit 240C and hangs down on a side (direction D3 side) opposite to the fourth ring unit 240C with respect to the first pole 220C.

As shown in (E) of FIG. 6, the tip 21C of the lace 20C moves in the direction D1 along the first pole 220C, crosses over the outer side (direction D3 side) of the third ring unit 410C in the direction D1 (21), and crosses over the top portion 230C in the direction D4 (22). Thereafter, the tip 21C moves in the direction D2 along the first pole 220C, crosses over the outer side (direction D4 side) of the third ring unit 410C in the direction D2 (23), moves in the direction D2 along the third pole 420C, and passes through the inner side of the fourth ring unit 240C in the direction D2 (24). In this state, the lace 20C hangs on the second ring unit 310C and sandwiches the third pole 420C on a side (direction D4 side) opposite to the first ring unit 210C with respect to the first pole 220C.

As shown in (F) of FIG. 6, the tip 21C of the lace 20C moves in the direction D1 along the third pole 420C, crosses over the outer side (direction D4 side) of the fourth ring unit 240C in the direction D1 (25), moves in the direction D1 along the third pole 420C and the first pole 220C, and crosses over the top portion 320C in the direction D3 (26). Thereafter, the tip 21C moves in the direction D2 along the first pole 220C, crosses over the outer side (direction D3 side) of the third ring unit 410C in the direction D2 (27), passes through the inner side of the second ring unit 310C in the direction D2 (28), passes through the inner side of the first ring unit 210C in the direction D2 (29), and crosses over the outer side (direction D4 side) of the fifth ring unit 510C in the direction D2 (30). In this state, the lace 20C is in a state of being entangled with the second pole 320C and the fifth pole 520C. In this state, only the second pole 320C and the fifth pole 520C exists at the inner side of the lace 20C.

As shown in (A) of FIG. 7, the tip 21C of the lace 20C moves in the direction D1 along the first pole 220C, passes through the inner side of the fifth ring unit 510C in the direction D1 (31), passes through the inner side of the first ring unit 210C in the direction D1 (32), passes through the inner side of the second ring unit 310C in the direction D1 (33), crosses over the outer side (direction D3 side) of the third ring unit 410C in the direction D1 (34), and crosses over the top portion 230C in the direction D4 (35). Thereafter, the tip 21C moves in the direction D2 along the first pole 220C, crosses over the outer side (direction D4 side) of the third ring unit 410C in the direction D2 (36), moves in the direction D2 along the third pole 420C, and crosses over the outer side (direction D4 side) of the fourth ring unit 240C in the direction D2 (37). Although this state is similar to the state shown in (E) of FIG. 6, it is different from the state shown in (E) of FIG. 6 in that the lace 20C passes through the inner side of the fifth ring unit 510C.

As shown in (B) of FIG. 7, the tip 21C of the lace 20C moves in the direction D1 along the third pole 420C, passes through the inner side of the fourth ring unit 240C in the direction D1 (38), moves in the direction D1 along the third pole 420C and the first pole 220C, and crosses over the top portion 230C in the direction D3 (39). Thereafter, the tip 21C moves in the direction D2 along the first pole 220C, crosses over the outer side (direction D3 side) of the third ring unit 410C in the direction D2 (40), turns and moves in the direction D1 along the first pole 220C, passes through the inner side of the third ring unit 410C in the direction D1 (40), and crosses over the top portion 230C in the direction D4 (41). Thereafter, the tip 21C moves in the direction D2 along the first pole 220C, passes through the inner side of the third ring unit 410C in the direction D2 (42), passes through the inner side of the fourth ring unit 240C in the direction D2 (43), and passes through the inner side of the second ring unit 310C in the direction D2 (44). Although this state is similar to the state shown in (C) of FIG. 6, it is different from the state shown in (C) of FIG. 6 in that the lace 20C passes through the inner side of the fifth ring unit 510C.

As shown in (C) of FIG. 7, the tip 21C of the lace 20C moves in the direction D1 along the first pole 220C, crosses over the outer side (direction D4 side) of the second ring unit 310C (45), passes through the inner side of the fourth ring unit 240C in the direction D1 (46), and passes through the inner side of the third ring unit 410C in the direction D1 (47), and crosses over the top portion 230C in the direction D3 (48). Thereafter, the tip 21C moves in the direction D2 along the first pole 220C and passes through the inner side of the third ring unit 410C in the direction D2 (49). Although this state is similar to the state shown in (B) of FIG. 6, it is different from the state shown in (B) of FIG. 6 in that the lace 20C passes through the inner side of the fifth ring unit 510C.

As shown in (D) of FIG. 7, the tip 21C of the lace 20C moves in the direction D1 along the first pole 220C, crosses over the outer side (direction D3 side) of the third ring unit 410C in the direction D1 (50), and crosses over the top portion 230C in the direction D4 (51). Thereafter, the tip 21C moves in the direction D2 along the first pole 220C, crosses over the outer side (direction D4 side) of the third ring unit 410C in the direction D2 (52), moves in the direction D2 along the third pole 420C, and passes through the inner side of the fourth ring unit 240C in the direction D2 (53). Although this state is similar to the state shown in (A) of FIG. 6, it is different from the state shown in (A) of FIG. 6 in that the lace 20C passes through the inner side of the fifth ring unit 510C.

As shown in (E) of FIG. 7, the tip 21C of the lace 20C moves in the direction D1 along the third pole 420C, crosses over the outer side (direction D4 side) of the fourth ring unit 240C in the direction D1 (54), moves in the direction D1 along the third pole 420C and the first pole 220C, and crosses over the top portion 230C in the direction D3 (55). Thereafter, as the tip 21C moves in the direction D2 along the first pole 220C, crosses over the outer side (direction D3 side) of the third ring unit 410C in the direction D2 (56), crosses over the outer side (direction D3 side) of the second ring unit 310C in the direction D2 (57), moves in the direction D2 along the second pole 320C, passes through the inner side of the first ring unit 210C in the direction D2 (58), and passes through the inner side of the fifth ring unit 510C in the direction D2 (59), the lace 20C is in a state of being entangled only with the fifth pole 520C (a state in which the puzzle is solved). In this state, only the fifth pole 520C exists at the inner side the lace 20C.

The methods of solving the wisdom ring puzzle shown in the above embodiment are merely examples, and there are various methods other than the above.

Each of the embodiments described above as an embodiment of the present invention can be appropriately combined as long as no contradiction is caused. Further, the addition, deletion, or design change of components, or the addition, deletion, or condition change of processes as appropriate by those skilled in the art based on each embodiment are also included in the scope of the present invention as long as they are provided with the gist of the present invention.

Further, it is understood that, even if the effect is different from those provided by each of the above-described embodiment, the effect obvious from the description in the specification or easily predicted by persons ordinary skilled in the art is apparently derived from the present invention the present invention provides other operational effects that are different from the operational effects arranged by the above embodiments, and those that are obvious from the description of the present specification or those that can be easily predicted by a person skilled in the art.

According to an embodiment of the present invention, it is possible to provide a wisdom ring puzzle capable of sustaining the interest and motivation of a player to create a solution.

What is claimed is:

1. A wisdom ring puzzle comprising:

a stage;

a first ring unit positioned in a first direction with respect to the stage;

a second ring unit positioned in the first direction with respect to the first ring unit;

a third ring unit positioned in the first direction with respect to the second ring unit;

a first pole connected to the first ring unit and the stage, and passing through an inner side of the second ring unit and an inner side of the third ring unit;

a second pole connected to the second ring unit and connected to the stage through an inner side of the first ring unit; and a third pole connected to the third ring unit and connected to the stage crossing over an outer side of the first ring unit and an outer side of the second ring unit, wherein the first ring unit and the first pole are immovably fixed to each other and the second ring unit and the second pole are immovably fixed to each other.

2. The wisdom ring puzzle according to claim 1, further comprising a fourth ring unit between the second ring unit and the third ring unit, wherein the fourth ring unit is connected to the first pole, and the third pole is connected to the stage through an inner side of the fourth ring unit.

3. The wisdom ring puzzle according to claim 1, further comprising:

a fifth ring unit between the stage and the first ring unit; and a fifth pole connected to the fifth ring unit and connected to the stage, wherein the second pole is connected to the stage through the inner side of the first ring unit and an inner side of the fifth ring unit.

4. The wisdom ring puzzle according to claim 3, wherein the first pole is connected to the stage crossing over an outer side of the fifth ring unit.

5. The wisdom ring puzzle according to claim 3, wherein the third pole is connected to the stage crossing over an outer side of the fifth ring unit.

6. The wisdom ring puzzle according to claim 2, further comprising:

a fifth ring unit between the stage and the first ring unit; and a fifth pole connected to the fifth ring unit and connected to the stage, wherein the second pole is connected to the stage through the inner side of the first ring unit and an inner side of the fifth ring unit.

7. The wisdom ring puzzle according to claim 6, wherein the first pole is connected to the stage crossing over an outer side of the fifth ring unit.

8. The wisdom ring puzzle according to claim 6, wherein the third pole is connected to the stage crossing over an outer side of the fifth ring unit.

9. The wisdom ring puzzle according to claim 1, further comprising:

a fourth ring unit between the second ring unit and the third ring unit;

a fifth ring unit between the stage and the first ring unit; and a fifth pole connected to the fifth ring unit and connected to the stage, wherein the fourth ring unit is connected to the first pole, the third pole is connected to the stage through an inner side of the fourth ring unit, the second pole is connected to the stage through the inner side of the first ring unit and an inner side of the fifth ring unit, and the first pole and the third pole are connected to the stage crossing over an outer side of the fifth ring unit.

10. The wisdom ring puzzle according to claim 1, wherein the second ring unit is connected to the second pole at an end portion of the second pole in the first direction, and the third ring unit is connected to the third pole at an end portion of the third pole in the first direction.

11. The wisdom ring puzzle according to claim 3, wherein the second ring unit is connected to the second pole at an end portion of the second pole in the first direction, the third ring unit is connected to the third pole at an end portion of the third pole in the first direction, and the fifth ring unit is connected to the fifth pole at an end portion of the fifth pole in the first direction.

12. The wisdom ring puzzle according to claim 1, wherein the second pole is connected to an end portion of the second ring unit in a third direction intersecting with the first direction, the first pole is connected to an end portion of the first ring unit in a fourth direction opposite to the third direction, and the third pole is connected to an end portion of the third ring unit in the fourth direction.

13. The wisdom ring puzzle according to claim 2, wherein the first pole is connected to an end portion of the fourth ring unit in a third direction intersecting with the first direction, the second pole is connected to an end portion of the second ring unit in the third direction, the first pole is connected to an end portion of the first ring unit in a fourth direction opposite to the third direction, and the third pole is connected to an end portion of the third ring unit in the fourth direction.

14. The wisdom ring puzzle according to claim 3, wherein the second pole is connected to an end portion of the second ring unit in the third direction intersecting with the first direction, the fifth pole is connected to an end portion of the fifth ring unit in the third direction, the first pole is connected to an end portion of the first ring unit in the fourth direction opposite to the third direction, and the third pole is connected to an end portion of the third ring unit in the fourth direction.

15. The wisdom ring puzzle according to claim 6, wherein the first pole is connected to an end portion of the fourth ring unit in the third direction intersecting with the first direction, the second pole is connected to an end portion of the second ring unit in the third direction, the fifth pole is connected to an end portion of the fifth ring unit in the third direction, the first pole is connected to an end portion of the first ring unit in the fourth direction opposite to the third direction, and the third pole is connected to an end portion of the third ring unit in the fourth direction.

16. A wisdom ring puzzle comprising:

a stage;

a first ring unit positioned in a first direction with respect to the stage;

a second ring unit positioned in the first direction with respect to the first ring unit;

a third ring unit positioned in the first direction with respect to the second ring unit;

a first pole connected to the first ring unit and the stage, and passing through an inner side of the second ring unit and an inner side of the third ring unit;

a second pole connected to the second ring unit and connected to the stage through an inner side of the first ring unit;

a third pole connected to the third ring unit and connected to the stage crossing over an outer side of the first ring unit and an outer side of the second ring unit; and a fourth ring unit between the second ring unit and the third ring unit, wherein the fourth ring unit is connected to the first pole, and the third pole is connected to the stage through an inner side of the fourth ring unit.

17. A wisdom ring puzzle comprising:

a stage;

a first ring unit positioned in a first direction with respect to the stage;

a second ring unit positioned in the first direction with respect to the first ring unit;

a third ring unit positioned in the first direction with respect to the second ring unit;

a first pole connected to the first ring unit and the stage, and passing through an inner side of the second ring unit and an inner side of the third ring unit;

a second pole connected to the second ring unit and connected to the stage through an inner side of the first ring unit;

a third pole connected to the third ring unit and connected to the stage crossing over an outer side of the first ring unit and an outer side of the second ring unit;

a further ring unit between the stage and the first ring unit; and a further pole connected to the further ring unit and connected to the stage, wherein the second pole is connected to the stage through the inner side of the first ring unit and an inner side of the further ring unit.

* * * * *